US012422151B2

(12) United States Patent
Wang et al.

(10) Patent No.: US 12,422,151 B2
(45) Date of Patent: Sep. 23, 2025

(54) SOUND AND VIBRATION DAMPING ENCLOSURES FOR REFRIGERANT COMPRESSORS OF CLIMATE CONTROL SYSTEMS

(71) Applicant: Trane International Inc., Davidson, NC (US)

(72) Inventors: Percy F. Wang, Tyler, TX (US); Beth Robinson, Tyler, TX (US); Don A. Schuster, Lindale, TX (US); Hannah Exner, La Crosse, WI (US)

(73) Assignee: Trane International Inc., Davidson, NC (US)

( * ) Notice: Subject to any disclaimer, the term of this patent is extended or adjusted under 35 U.S.C. 154(b) by 87 days.

(21) Appl. No.: 18/486,664

(22) Filed: Oct. 13, 2023

(65) Prior Publication Data

US 2025/0123008 A1 Apr. 17, 2025

(51) Int. Cl.
*F24F 1/12* (2011.01)
*F24F 13/24* (2006.01)

(52) U.S. Cl.
CPC ..... *F24F 1/12* (2013.01); *F24F 2013/242* (2013.01)

(58) Field of Classification Search
CPC ..... F24F 1/12; F24F 2013/242
USPC ..... 62/296
See application file for complete search history.

(56) References Cited

U.S. PATENT DOCUMENTS 4,982,812 A 1/1991 Hwang
5,151,018 A 9/1992 Clendenin et al.
5,274,200 A 12/1993 Das et al.
5,588,810 A 12/1996 DiFlora et al.
6,062,033 A * 5/2000 Choi ..... F24F 13/24 62/296
6,932,190 B2 * 8/2005 Sishtla ..... F16L 55/0336 181/290
7,357,219 B2 * 4/2008 Mafi ..... F24F 13/24 181/290
7,398,855 B2 7/2008 Seel
8,434,591 B2 5/2013 Cherniak et al.
2011/0100748 A1 * 5/2011 Nonogi ..... G10K 11/172 181/291
2018/0339716 A1 * 11/2018 Tanaka ..... B61D 27/0018
2020/0041145 A1 * 2/2020 Kitabatake ..... F24F 1/12
2021/0010715 A1 * 1/2021 Davtyan ..... F24F 13/24

FOREIGN PATENT DOCUMENTS

CN 104748252 7/2015
CN 106679238 5/2017
CN 109026608 12/2018
JP 11159813 A * 6/1999
JP 2011052842 3/2011

* cited by examiner

*Primary Examiner* — Steve S Tanenbaum

(74) *Attorney, Agent, or Firm* — Womble Bond Dickinson (US) LLP

(57) ABSTRACT

An embodiment of an outdoor unit for a climate control system includes a refrigerant compressor. In addition, the outdoor unit includes a plurality of refrigerant lines coupled to the refrigerant compressor. Further, the outdoor unit includes an enclosure positioned around the refrigerant compressor, wherein the enclosure includes an inner jacket and an outer jacket, the inner jacket being engaged with the outer jacket such that the inner jacket is configured to deform independently from the outer jacket to dissipate vibration emitted from the refrigerant compressor.

20 Claims, 14 Drawing Sheets

SOUND AND VIBRATION DAMPING ENCLOSURES FOR REFRIGERANT COMPRESSORS OF CLIMATE CONTROL SYSTEMS

CROSS-REFERENCE TO RELATED APPLICATIONS

Not applicable.

TECHNOLOGICAL FIELD

This disclosure generally relates to climate control systems. More particularly, this disclosure relates to systems and methods for dissipating noise and vibration emitted from a refrigerant compressor of a climate control system.

BACKGROUND

A climate control system may be used to heat, cool, dehumidify, or otherwise condition the air in an indoor space. Examples of climate control systems include heating, ventilation, and air conditioning (HVAC) systems (e.g., air conditioning systems, heat pumps, furnaces, etc.). The indoor space may include the interior space of a home, retail business, office, storage space, the cab of a vehicle, a storage container of a freezer or refrigerator, etc.

In some circumstances, a climate control system may circulate a refrigerant through one or more heat exchangers in order to condition (e.g., cool or heat) air that is within or delivered to the indoor space. One or more refrigerant compressors may be used to facilitate the circulation of refrigerant during operations. However, a refrigerant compressor may generate large amounts of noise and vibration that may be unpleasant for persons located nearby and that may result in damage or failure (e.g., such as fatigue failure) of one or more components of the climate control system or other adjacent structures or systems.

BRIEF SUMMARY

Some embodiments disclosed herein are directed to an outdoor unit for a climate control system. In some embodiments, the outdoor unit includes a refrigerant compressor, and a plurality of refrigerant lines coupled to the refrigerant compressor. In addition, the outdoor unit includes an enclosure positioned around the refrigerant compressor, wherein the enclosure includes an inner jacket and an outer jacket, the inner jacket being engaged with the outer jacket such that the inner jacket is configured to deform independently from the outer jacket to dissipate vibration emitted from the refrigerant compressor.

In some embodiments, the outdoor unit includes a refrigerant compressor, and a heat exchanger comprising one or more heat exchanger tubes positioned about the refrigerant compressor. In addition, the outdoor unit includes an enclosure positioned between the heat exchanger and the refrigerant compressor, the enclosure comprising a plurality of nested jackets that are movable relative to one another so that the enclosure is configured to convert vibration emitted from the refrigerant compressor into frictional heat between the plurality of nested jackets, each of the plurality of nested jackets including a sound absorbing layer and a sound barrier layer.

In some embodiments, the outdoor unit includes a refrigerant compressor, a plurality of refrigerant lines coupled to the refrigerant compressor, and an enclosure positioned about the refrigerant compressor. The enclosure includes a plurality of flapped openings that receive the plurality of refrigerant lines therethrough, the plurality of flapped openings configured to apply force to the plurality of refrigerant lines to damp vibrations therein, and at least one sound absorbing layer that is configured to absorb sound emitted from the refrigerant compressor.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

As previously described, a climate control system may circulate a refrigerant through one or more heat exchangers to adjust (e.g., increase or decrease) a temperature of an indoor space. The refrigerant may be circulated via operation of one or more refrigerant compressors, which may generate large amounts of noise and vibration during operation. The noise and vibration generated by a refrigerant compressor may be unpleasant and irritating to persons located near the refrigerant compressor. Additionally, the vibration emanating from an operating refrigerant compressor may also cause damage to the climate control system and/or other adjacent structures or systems over time. For instance, the vibrations emitted from a refrigerant compressor may cause corresponding vibration or reciprocal movement of one or more refrigerant lines coupled to the compressor which may eventually lead to fatigue failure and loss of containment of the refrigerant itself.

Accordingly, embodiments disclosed herein include enclosures for a refrigerant compressor of a climate control system that may dissipate both sound and vibration emitted from the refrigerant compressor during operation. In some embodiments, the enclosures disclosed herein may include a plurality of nested jackets that are loosely coupled to one another so that the vibrations emitted from the refrigerant compressor may allow independent movement and deformation of the nested jackets relative to one another. The relative, independent movement of the nested jackets may convert the vibrations (and the corresponding noise) into frictional heat during operation so as to dissipate at least a portion of the vibrations during operations. As a result, through use of the embodiments disclosed herein, the noise pollution and fatigue wear associated with a refrigerant compressor of a climate control system may be reduced.

Figure 1:
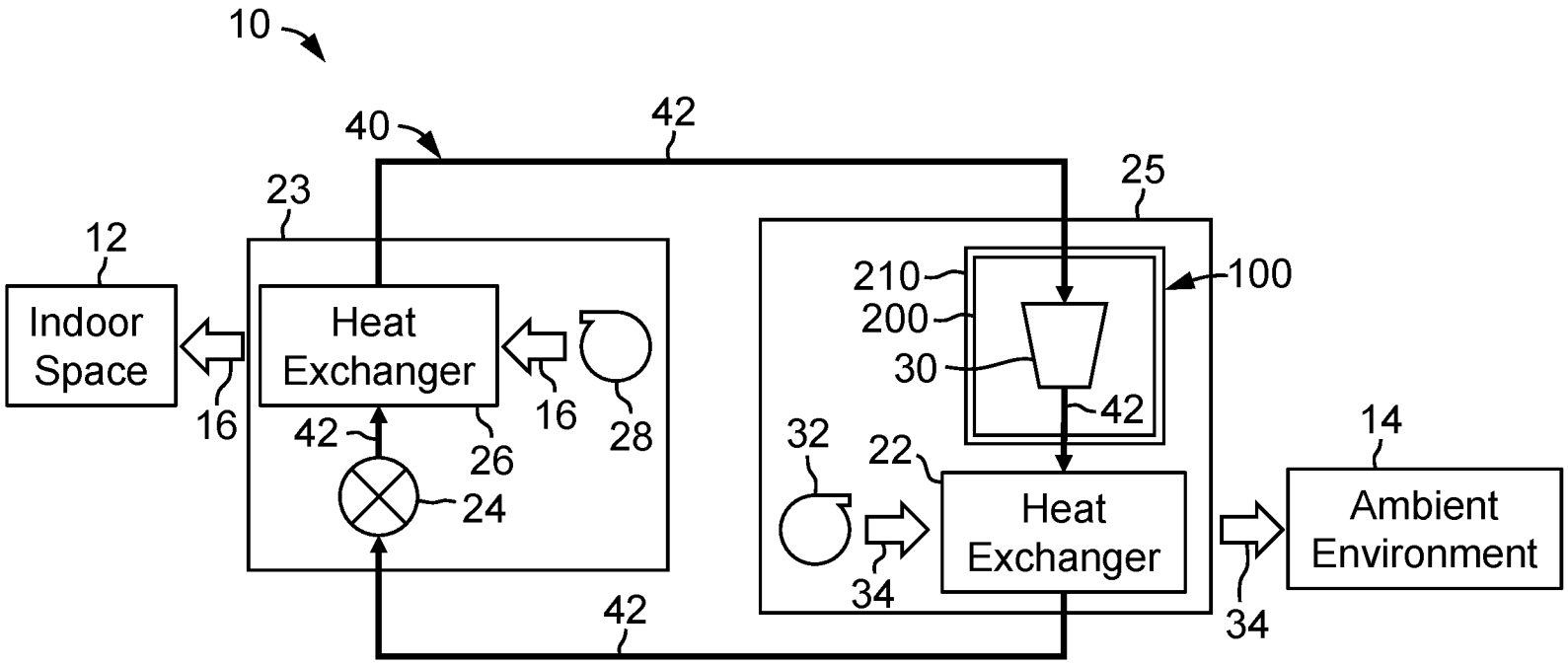
FIG. 1 is a schematic diagram of a climate control system including an enclosure at least partially surrounding a refrigerant compressor according to some embodiments disclosed herein.

Referring now to FIG. 1, a climate control system 10 including a sound and vibration damping enclosure 100 at least partially surrounding a refrigerant compressor 30 is shown according to some embodiments. As will be described in more detail below, the enclosure 100 may include a plurality of nested jackets 200, 210 that are deformable independent of one another to reduce noise and vibration emitted from the compressor 30 during operations. In the embodiment illustrated in FIG. 1, the climate control system 10 is configured as an air conditioning system to reduce a temperature of an indoor space 12. However, the particular configuration of the climate control system 10 shown in FIG. 1 is merely representative of some embodiments and should not be interpreted as limiting other particular arrangements of configurations thereof according to other embodiments. For instance, in some embodiments the climate control system 10 may be configured as a heat pump that may increase a temperature of the indoor space 12 via circulation of a refrigerant.

Generally speaking, the climate control system 10 may be configured to exchange heat between an indoor space 12 and an unconditioned ambient environment 14. The indoor space 12 may be the interior of a home, office, store, shipping container, refrigerator, freezer, or other interior space. In addition, the ambient environment 14 may be an outdoor environment that is outside of (and that may surround) the interior space 12.

The climate control system 10 generally includes a first heat exchanger 26, a refrigerant compressor 30, a second heat exchanger 22, and a modulating valve 24. The refrigerant compressor 30 may be more simply referred to herein as a "compressor." A plurality of refrigerant lines 42 are coupled to and interconnect the first heat exchanger 26, compressor 30, second heat exchanger 22, and modulating valve 24 to thereby define a refrigerant fluid circuit 40 (or more simply "fluid circuit") within the climate control system 10.

In some embodiments, the first heat exchanger 26 and modulating valve 24 may be embodied as an at least partially integrated first unit 23. In addition, in some embodiments, the compressor 30 and second heat exchanger 22 may be embodied as an at least partially integrated second unit 25. In some embodiments, the first unit 23 may be positioned in any suitable indoor space that may or may not be the same (or connected to) the indoor space 12. For instance, the first unit 23 may be positioned in an attic, storage room, basement, building, enclosure, that is proximate to, connected to, or at least partially integrated (or inside of) the indoor space 12. Likewise, the second unit 25 may be positioned in the ambient environment 14, which (as previously described) may be outdoors. Thus, the first unit 23 may be referred to herein as an "indoor unit" and the second unit 25 may be referred to herein as an "outdoor unit." However, these example positions of units 23, 25 are not intended to limit a particular location of either of the units 23, 25 in various embodiments. For example, in some embodiments, the indoor unit 23 and the outdoor unit 25 may be at least partially integrated with one another and co-located in an outdoor environment (e.g., such as in the case of a so-called "packaged unit" climate control system).

During operation, a refrigerant (or other heat transfer fluid) is circulated along the fluid circuit 40 between the units 23, 25 to exchange heat between the indoor space 12 and the ambient environment 14. Specifically, the compressor 30 may compress the refrigerant and output the compressed refrigerant to the second heat exchanger 22. The second heat exchanger 22 is configured to facilitate heat transfer between the refrigerant and the ambient environment 14. Because the climate control system 10 is configured as an air conditioner for cooling the indoor space 12, the second heat exchanger 22 shown in FIG. 1 is configured to transfer heat from the refrigerant to the ambient environment 14, and thereby condense (or substantially condense) the refrigerant from a vapor into a liquid. Thus, the second heat exchanger 22 may be referred to herein as a "condenser." A fan or blower 32 may generate an airflow 34 that is directed through, around, onto, etc. the second heat exchanger 22 so that heat may be transferred from the refrigerant to the airflow 34, which in turn flows into the ambient environment 14.

The liquid (or substantially liquid) refrigerant is then directed to the indoor unit 23. Within the indoor unit 23, the refrigerant is first directed through the modulating valve 24, whereby it is controllably expanded and reduced in temperature. The expanded, cold refrigerant is then directed through the first heat exchanger 26. The first heat exchanger 26 is configured to facilitate heat exchange between the refrigerant and an airflow 16 generated by a blower or fan 28. Specifically, the first heat exchanger 26 is configured to transfer heat from the airflow 16 to the refrigerant so that the airflow 16 is cooled prior to being flowed into the indoor space 12. As the refrigerant flows through the first heat exchanger 26, the heat from the airflow 16 causes the refrigerant to change phase from a liquid to a vapor. Thus, the first heat exchanger 26 may be referred to herein as an "evaporator." The vaporized (or substantially vaporized) refrigerant is then directed back to the outdoor unit 25, and particularly the compressor 30 to restart the cycle previously described above.

During operation with the climate control system 10, the compressor 30 may emit noise and vibration that is transferred to the surrounding environment (e.g., ambient environment 14) as well as adjacent components of the climate control system 10. In some embodiments, compressor 30 may be configured as a rotary compressor, which may generate relatively high amounts of vibration during operations. For instance, the vibrations emitted from the compressor 30 may be conducted through the refrigerant lines 42 and other components and may therefore result in excessive vibrational movement thereof. In addition, the compressor 30 (particularly when the compressor 30 is configured as a rotary compressor) may generate pressure pulsations in the refrigerant that may induce additional movement or vibration of the refrigerant lines 42 during operations. Over time, this vibrational movement may result in fatigue failure which may further lead to a loss of containment of the refrigerant. Accordingly, the climate control system 10, and particularly the outdoor unit 25, may include an enclosure 100 that at least partially encloses or surrounds the compressor 30 (and potentially other adjacent components) so as to dissipate at least some of the noise and vibration emitted from the compressor 30 during operations.

Figure 2:
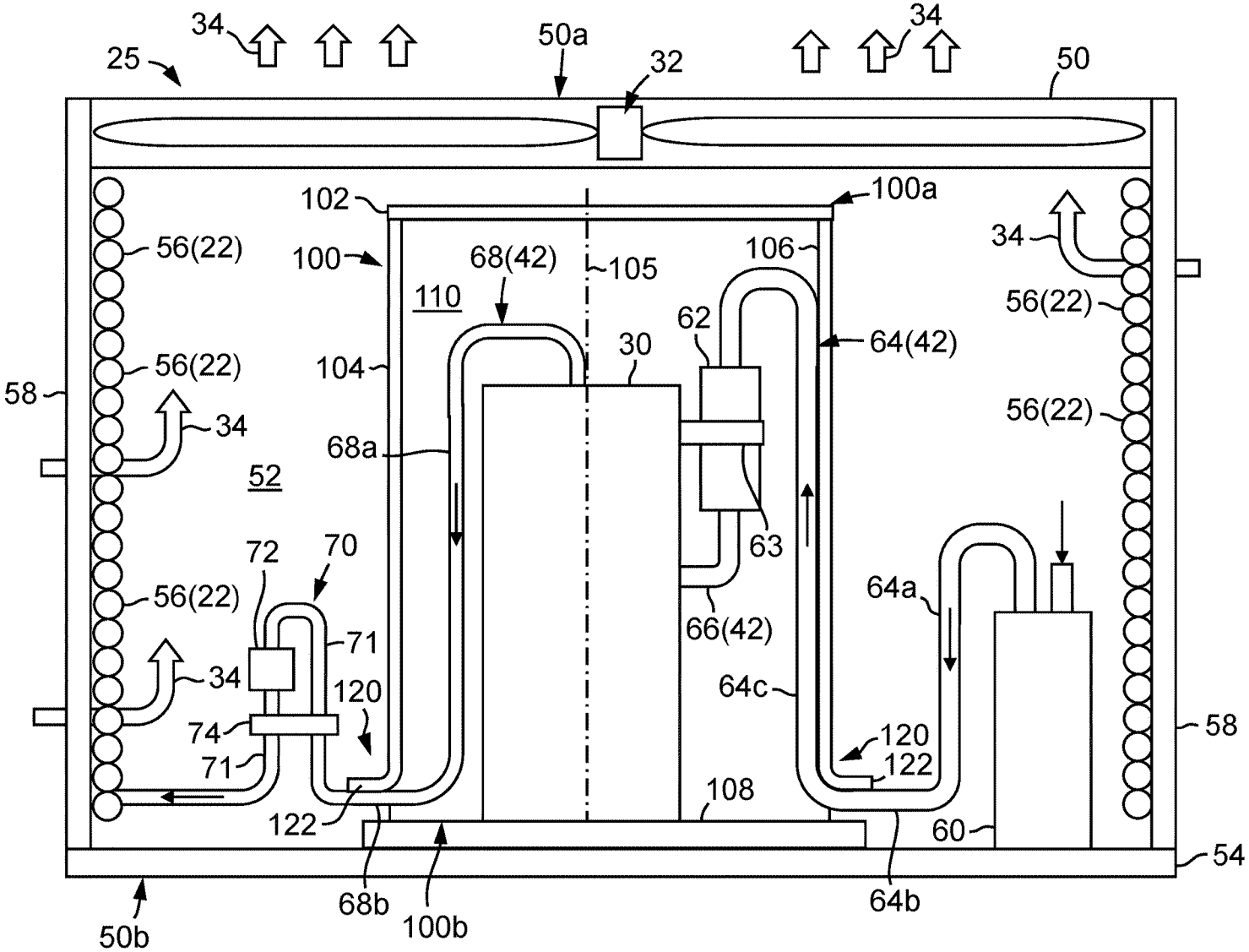
FIG. 2 is a schematic diagram of an outdoor unit of the climate control system of FIG. 1 according to some embodiments disclosed herein.
Figure 3:
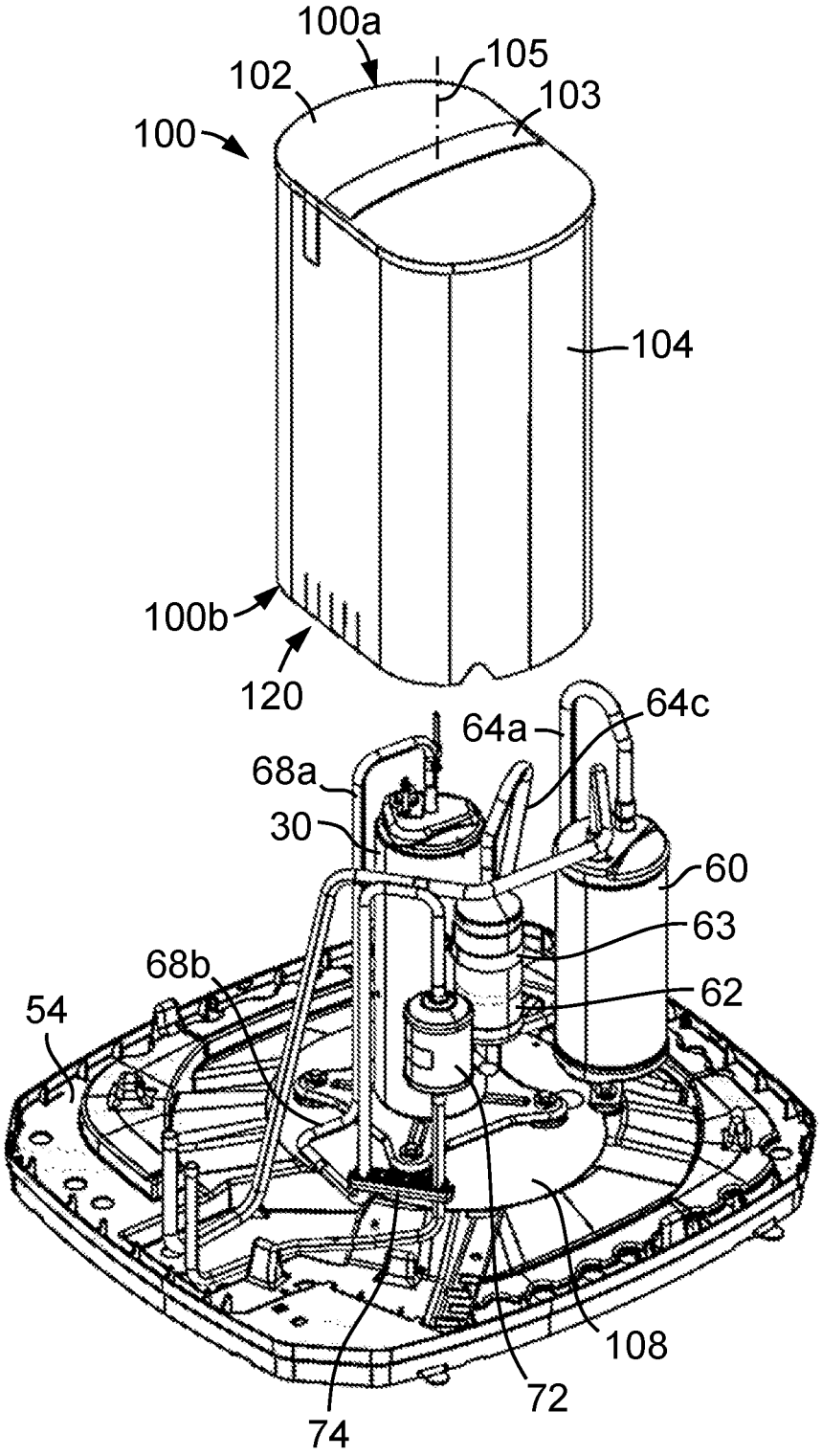
FIG. 3 is a perspective exploded view of the enclosure and refrigerant compressor a climate control system according to some embodiments disclosed herein.
Figure 4:
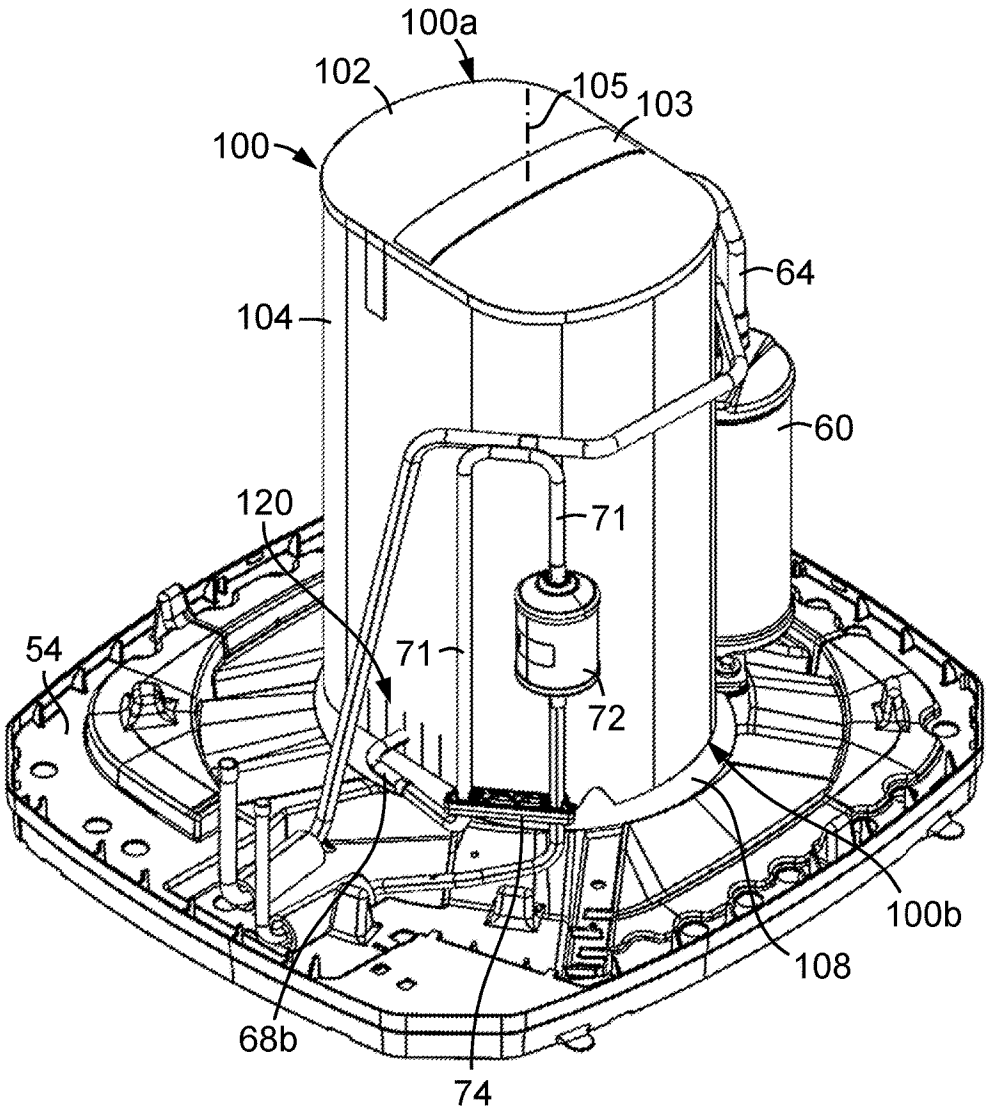
FIGS. 4 and 5 are left and right perspective views of the enclosure of FIG. 3 installed over the refrigerant compressor according to some embodiments disclosed herein.
Figure 5:
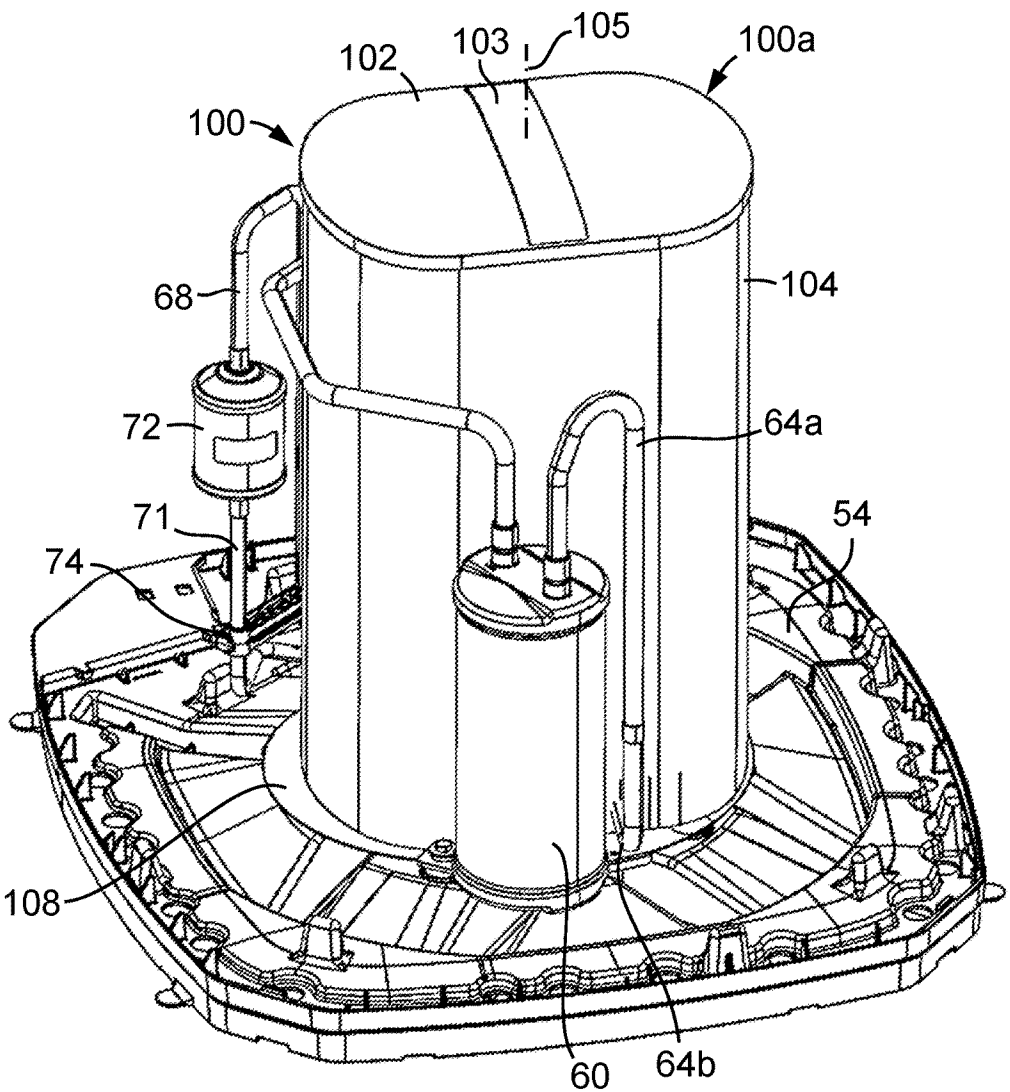

Referring now to FIG. 2, the outdoor unit 25 of climate control system 10 (FIG. 1) is shown according to some embodiments. The outdoor unit 25 may include a housing 50 that defines an internal chamber 52. The blower 32 may be positioned at a top end 50*a* of the housing 50, and a base pan 54 may be positioned at a bottom end 50*b* of the housing 50. One or more (e.g., one or a plurality of) heat exchanger tubes 56 may be arranged along a side wall 58 (which may be vented or porous) of the housing 50 and positioned between the blower 32 and base pan 54. The heat exchanger tubes 56 may at least partially define the condenser 22. Thus, the heat exchanger tubes 56 may be configured to exchange heat with the airflow 34 generated by the blower 32, and may thereby include fins (e.g., such as pin-fins, plate fins, etc.) or other heat exchange surfaces (not specifically shown). Specifically, the blower 32 may draw air into the chamber 52, through the side wall 58 and thus over and around the heat exchanger tubes 56 so as to transfer heat from the heat exchanger tubes 56 (and the refrigerant flowing therein) to the airflow 34.

The compressor 30 may be generally centrally located within the housing 50 and supported by the base pan 54. Thus, the heat exchanger tubes 56 may be positioned about or around the compressor 30. In particular, the compressor 30 may be positioned atop a base plate 108 which is further positioned on the base pan 54 of housing 50. As will be described in more detail below, the base plate 108 may be a laminated composite member that is configured to dissipate at least some vibrations emitted from the compressor 30 during operations.

One or more accumulators 60, 62 may be positioned within the internal chamber 52 and along the refrigerant lines 42 connected upstream of the compressor 30. Specifically, a first accumulator 60 may receive a flow of refrigerant (e.g., from the indoor unit 23 shown in FIG. 1) and may then output the refrigerant toward a second accumulator 62 via an accumulator suction line 64 of the plurality of refrigerant lines 42. The second accumulator 62 may then output the refrigerant to the compressor 30 via a compressor suction line 66 of the plurality of refrigerant lines 42. The second accumulator 62 may be smaller than the first accumulator 60 and may be secured to the compressor 30 via a bracket 63 that forms a cantilevered connection or support for the second accumulator 62 to the compressor 30. The accumulators 60, 62 may be configured to separate liquids out of the otherwise vaporized refrigerant to prevent the liquids from entering (and thereby potentially damaging or negatively impacting the performance of) the compressor 30.

The accumulator suction line 64 may have a generally U-shaped configuration, having a first or descending section 64*a* extending generally downward from the first accumulator 60 to a second or lower section 64*b* that extends laterally or horizontally proximate to base plate 108. In addition, the accumulator suction line 64 may include a third or ascending section 64*c* extending generally upward from the lower section 64*b* to the second accumulator 62.

The compressor 30 may output a compressed refrigerant stream to the plurality of heat exchanger tubes 56 of the condenser 22 via a compressor discharge line 68 of the plurality of refrigerant lines 42. The compressor discharge line 68 may have a first or descending section 68*a* that extends generally downward from the compressor 30, and a second or lower section 68*b* that extends generally laterally or horizontally from the descending section 68*a* proximate to the base plate 108. In addition, the compressor discharge line 68 may include an upward U-bend 70 connected to the lower section 68*b* and therefore positioned between the lower section 68*b* and the heat exchanger tubes 56 of condenser 22. A vibration dampening clip 74 is engaged to the legs 71 of the U-bend 70 to increase the stiffness of the compressor discharge line 68 between the compressor 30 and heat exchanger tubes 56. Further, a pulsation dampener 72 is positioned along one of the legs 71 of the U-bend 70 that is configured to at least partially dissipate pressure pulsations in the refrigerant discharged from the compressor 30 during operations.

Referring now to FIGS. 2-6, the enclosure 100 may be placed over and around the compressor 30 and supported on the base plate 108. Thus, as best shown in FIG. 2, the enclosure 100 may be placed over the compressor 30 and therefore positioned between the heat exchanger tubes 56 of condenser 22 and the compressor 30 within the housing 50. It should be appreciated that FIGS. 3-6 illustrate various perspective views of the enclosure 100 and some of the other components of the outdoor unit 25 that correspond with the schematic illustration shown in FIG. 2 according to some embodiments. However, it should be noted that some portion or components of the outdoor unit 25 (e.g., the blower 32, condenser 22, etc.) are not shown in FIGS. 3-6 so as to better illustrate the enclosure 100, compressor 30, refrigerant lines 42 (including lines 64, 66, 68), accumulators 60, 62, etc.

Figure 7:
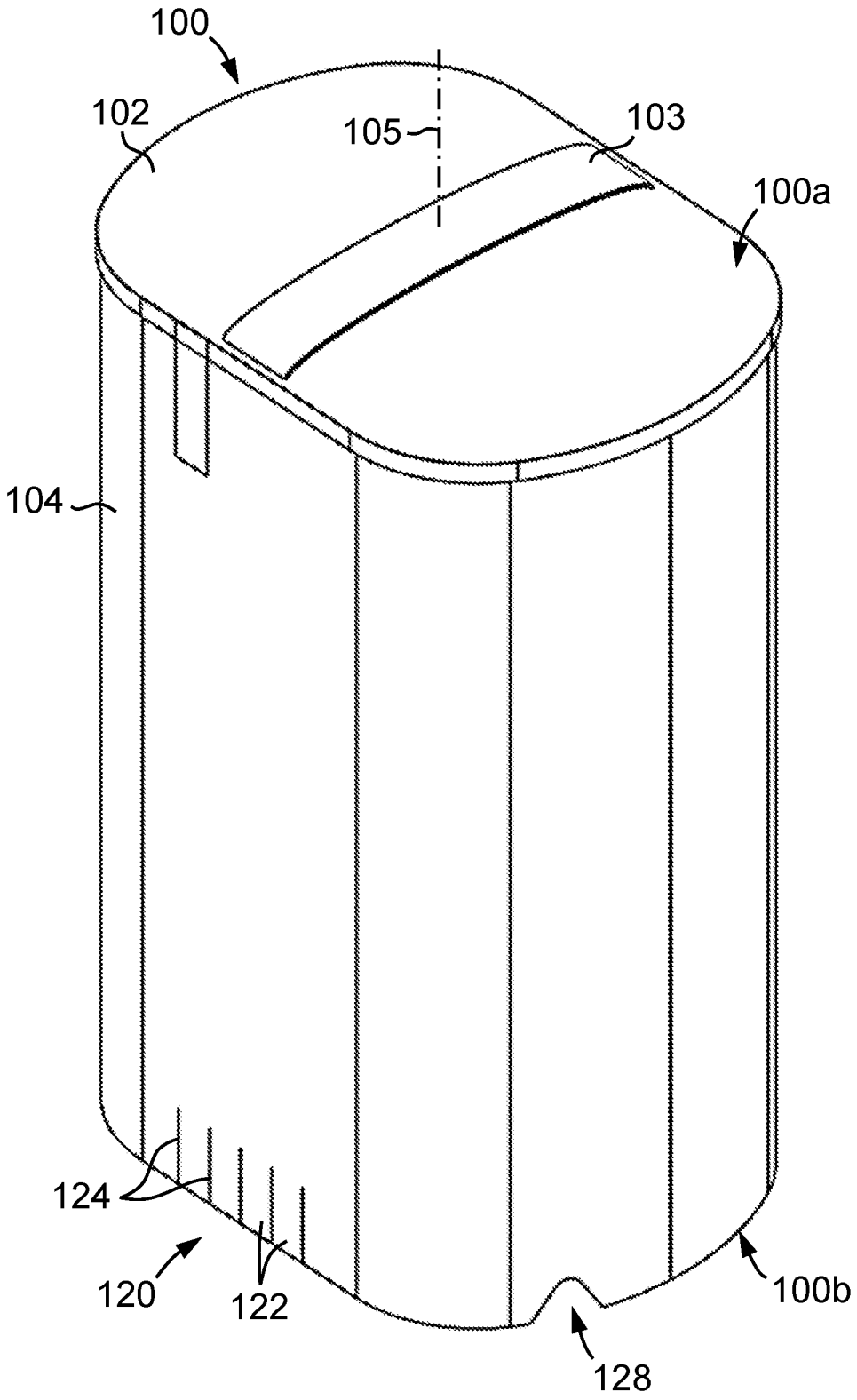
FIGS. 7 and 8 are left and right perspective views of the enclosure of FIG. 3 according to some embodiments disclosed herein.
Figure 8:
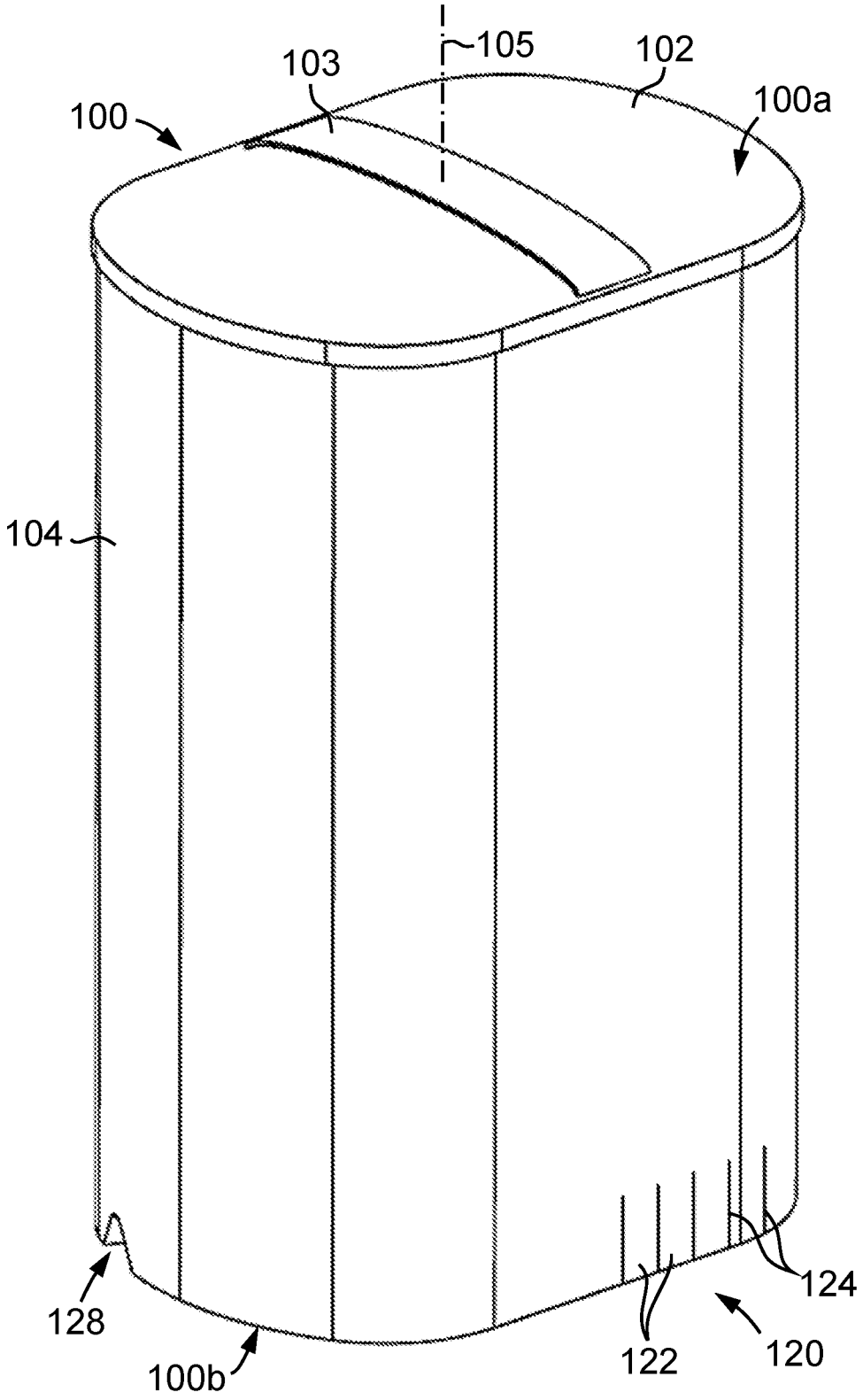
Figure 9:
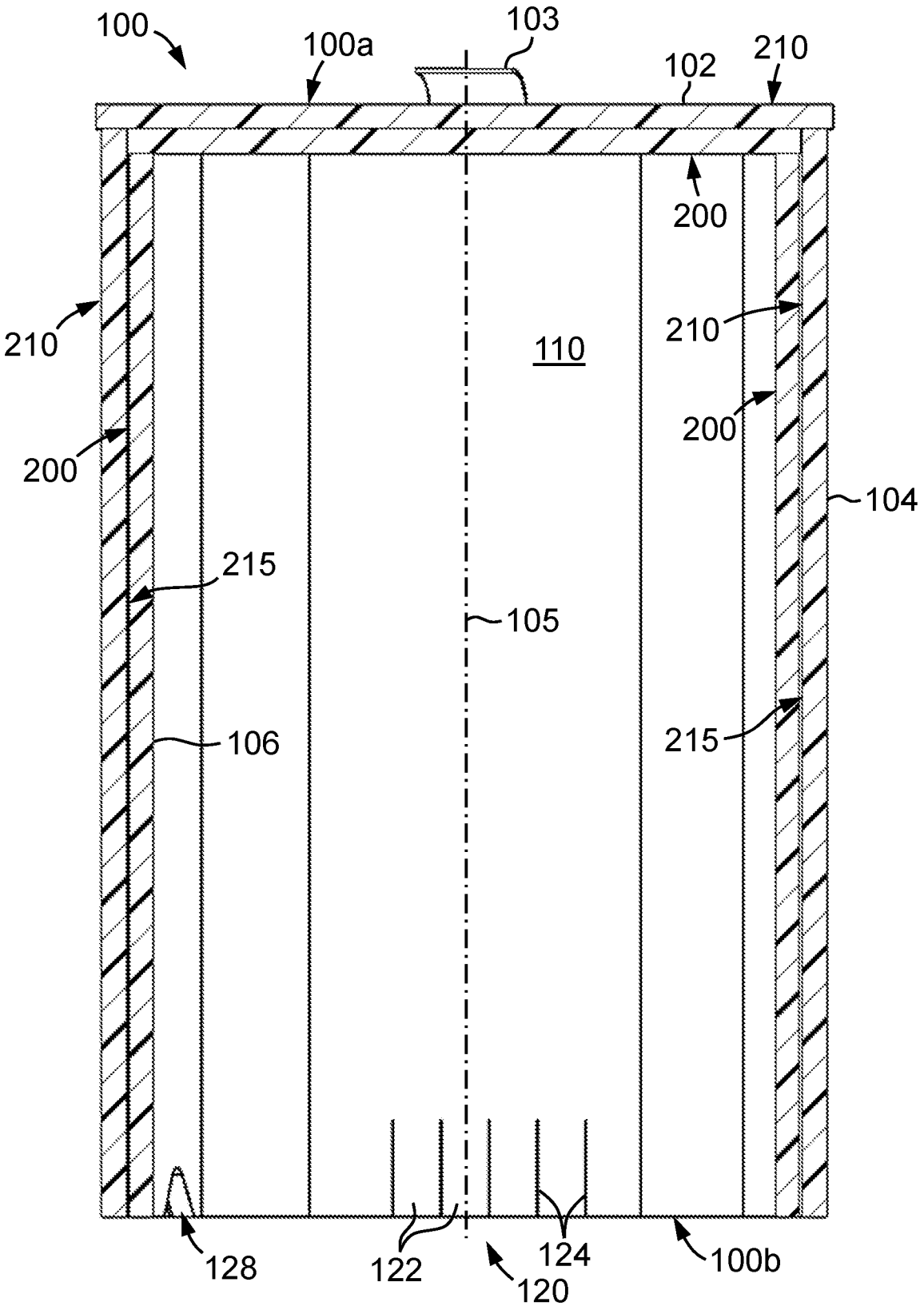
FIG. 9 is a side, cross-sectional view of the enclosure of FIG. 3 according to some embodiments disclosed herein.

Referring to FIGS. 7-9, the enclosure 100 may include a central or longitudinal axis 105, a first or upper end 100*a*, and a second or lower end 100*b* spaced from the upper end 100*a* along the axis 105. The upper end 100*a* is a closed upper end that includes a cap or top 102. The cap 102 of the enclosure 100 may include a handle 103 that may facilitate both installation and removal of the enclosure 100 into and out of (respectively) the housing 50 of outdoor unit 25 during operations.

The lower end 100*b* is an open lower end that is engaged with the base plate 108. The enclosure 100 includes a side wall 104 that extends from the cap 102 to the open bottom end 100*b*. The side wall 104 may have any suitable shape or cross-section in a radial plane relative to the central axis 105 to be suitable for providing the features and benefits discussed herein. For instance, in some embodiments, the side wall 104 may have a radial cross-section that is generally circular, elliptical, ovoid, obround, rectangular, triangular, polygonal, etc. The side wall 104 and cap 102 may define a cavity 110 within the enclosure 100 that extends from the open bottom end 100*b* to the closed top end 100*a*.

As best shown in FIG. 9, the enclosure 100 may be formed from a plurality of nested jackets, such as, for instance a first or inner jacket 200 and a second or outer jacket 210 that is positioned about the inner jacket 200. The inner jacket 200 may be positioned radially closer to the central axis 105 than the outer jacket 210. The nested jackets 200, 210 may form or define both the side wall 104 and, in some embodiments, also the cap 102 (however, in some embodiments, the cap 102 may be constructed from a different material and/or using a different number of layers than the side wall 104). The nested jackets 200, 210 may be loosely coupled to one another so that the jackets 200, 210 may freely move and/or deform independently, relative to one another. For instance, the nested jackets 200, 210 may be connected to one another at one or more discrete points (e.g., via rivets, nails, brads, buttons, threads, adhesive) or seams (e.g., via thread, adhesive, etc.) in order to prevent complete disassembly of the nested jackets 200, 210 while still allowing free deformation of the inner jacket 200 relative to and independent from the outer jacket 200 during operations. For instance, in some embodiments, a connected surface area between the outer surface area of the inner jacket 200 and the inner surface of the outer jacket 210 may be about 0.5 $in^2$ or less, with a remainder of the surface areas of the outer surface area of the inner jacket 200 and inner surface of the outer jacket 210 being unconnected (that is-unsecured) to one another. As a result, there may be a discontinuity or gap 215 between the jackets 200, 210 to facilitate the relative movement or deformation thereof during operations.

Figure 10:
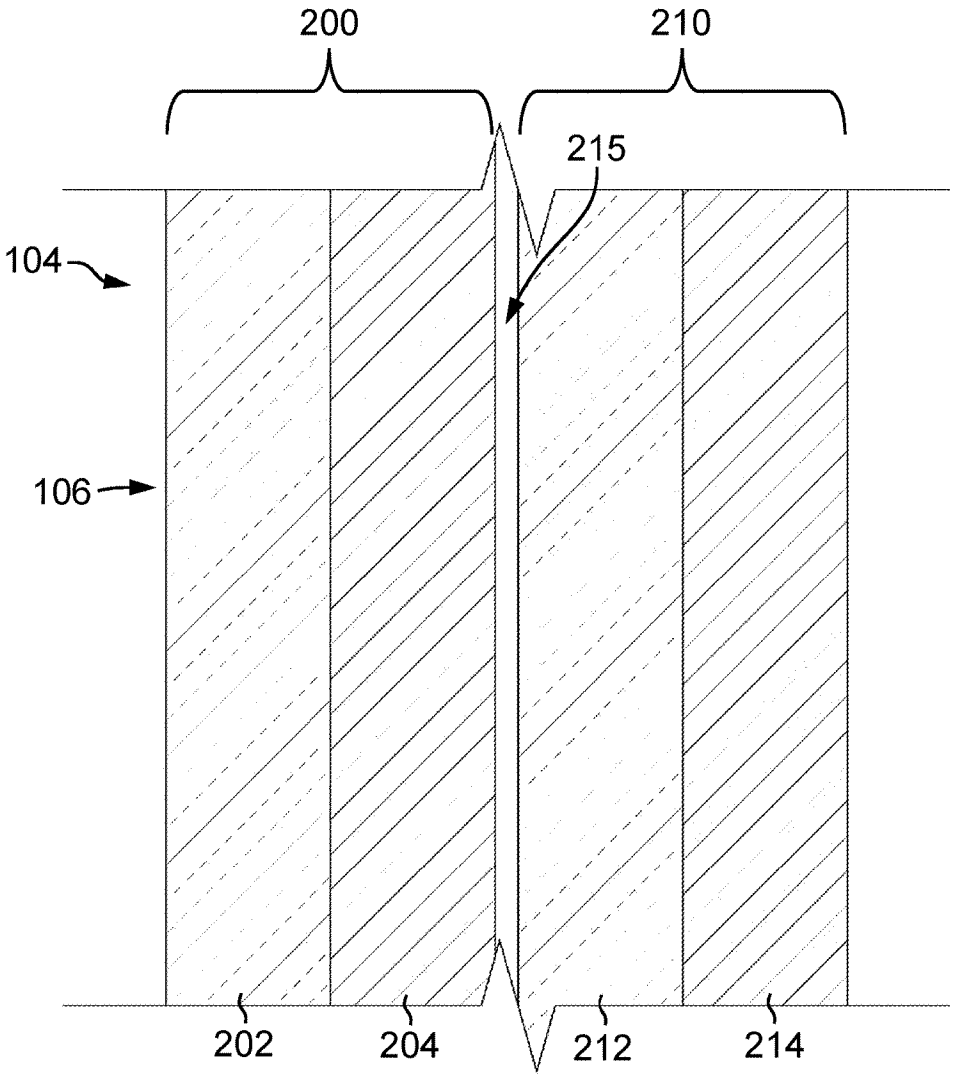
FIG. 10 is a cross-sectional view of a plurality of nested jacket of the enclosure of FIG. 3 according to some embodiments.

Referring now to FIG. 10, an enlarged cross-section of the jackets 200, 210 of enclosure 100 is shown according to some embodiments. The cross-section shown in FIG. 10 is taken along the side wall 104 of the enclosure 100. Each of the jackets 200, 210 may include a plurality of layers that are connected or laminated together so that each of the jackets 200, 210 may themselves be considered composite layers. Specifically, the inner jacket 200 may include a first layer 202 and a second layer 204, and the outer jacket 210 may include a third layer 212 and a fourth layer 214. The jackets 200, 210 may be arranged and configured so that the layers 202, 212 may be the innermost layers (e.g., radially innermost relative to axis 105) of the jackets 200, 210, respectively, and the layers 204, 214 may be the outermost layers (e.g., radially outermost relative to axis 105) of the jackets 200, 210, respectively. As a result, the first layer 202 of the inner jacket 200 may define the innermost surface of the enclosure 100 (including the inner surface 106 of side wall 104 as shown in FIG. 9), and the fourth layer 214 may define the outermost surface of the side wall 104 of enclosure 100. In addition, the second layer 204 of the inner jacket 200 may oppose (or be adjacent to) the third layer 212 of the outer jacket 210 so that the discontinuity or gap 215 is formed and positioned between the layers 204, 212.

The first layer 202 of inner jacket 200 and the third layer 212 of outer jacket 210 may be sound absorbing layers and thus may comprise sound absorbing material(s). As used herein a "sound absorbing" layer or material may include any suitable material(s) that is configured to absorb a majority of sound energy that is directed thereon. In some embodiments, a sound absorbing layer or material (e.g., such as the layers 202, 212) may include a porous material such as a foam material (e.g., such as open-cell foam), fibrous material (e.g., cotton or fiberglass batting), or a combination thereof. For instance, a sound absorbing material may have a relatively high sound absorption coefficient (e.g., greater than about 0.60, such as above about 0.70, such as above about 0.80, or above about 0.90, for sound frequencies of 500 Hz or higher).

The second layer 204 of inner jacket 200 and the fourth layer 214 of outer jacket 210 may be sound barrier layers and may comprise sound barrier material(s). As used herein a "sound barrier" layer or material may include any suitable material(s) that is configured to block at least some sound transmission therethrough (e.g., by reflecting the sound). In some embodiments, the "sound barrier" material(s) of the layers 204, 214 may comprise one or more sheets of solid materials (e.g., one or more solid sheets), such as a polymer material (e.g., vinyl, such as mass loaded vinyl).

Within each jacket 200, 210, sound and vibration (e.g., sound and vibration emitted from compressor 30) may initially impact the sound absorbing layers 202, 212 and may be at least partially absorbed thereby. Additional sound and vibrations that are not absorbed may pass through the sound absorbing layers 202, 212 and may then impact the sound barrier layers 204, 214. The sound barrier layers 204, 214 may at least partially reflect sound and vibration back into the adjacent sound absorbing layers 202, 212 so that the reflected sound and vibrations are further absorbed therein.

In addition, the sound and vibrations may further cause the inner jacket 200 (including layers 202, 204) to flex and deform relative to and independent from the outer jacket 210 (including layers 212, 214). The deformation of the inner jacket 200 may cause sliding of the inner jacket 200 along the outer jacket 210 within the discontinuity 215 so that the vibrational energy is converted to frictional heat, thereby reducing the total amount of sound and vibrations that progress beyond the enclosure 100.

Referring again to FIGS. 2-6, as previously described, the enclosure 100 may be placed over and around the compressor 30 and supported on the base plate 108. In particular the lower end 100*b* may be engaged with the base plate 108 so that the enclosure 100 and base plate 108 may enclose the compressor 30 in the cavity 110. In addition, the second accumulator 62 and the accumulator suction line 64 and compressor discharge line 68 may also be received in the cavity 110 of enclosure 100 along with the compressor 30.

The lower end 100*b* may be engaged with the base plate 108 so as to minimize or eliminate gaps or openings therebetween where sound may escape from the cavity 110. In some embodiments, the lower end 100*b* of enclosure 100 may be urged against the base plate 108 via the weight of the enclosure 100 itself. Additionally or alternatively, in some embodiments, the base plate 108 may include one or more raised connection features or seats that may engage or interlock with the lower end 100*b* to further reduce gaps or openings between the lower end 100*b* and base plate 108.

Figure 6:
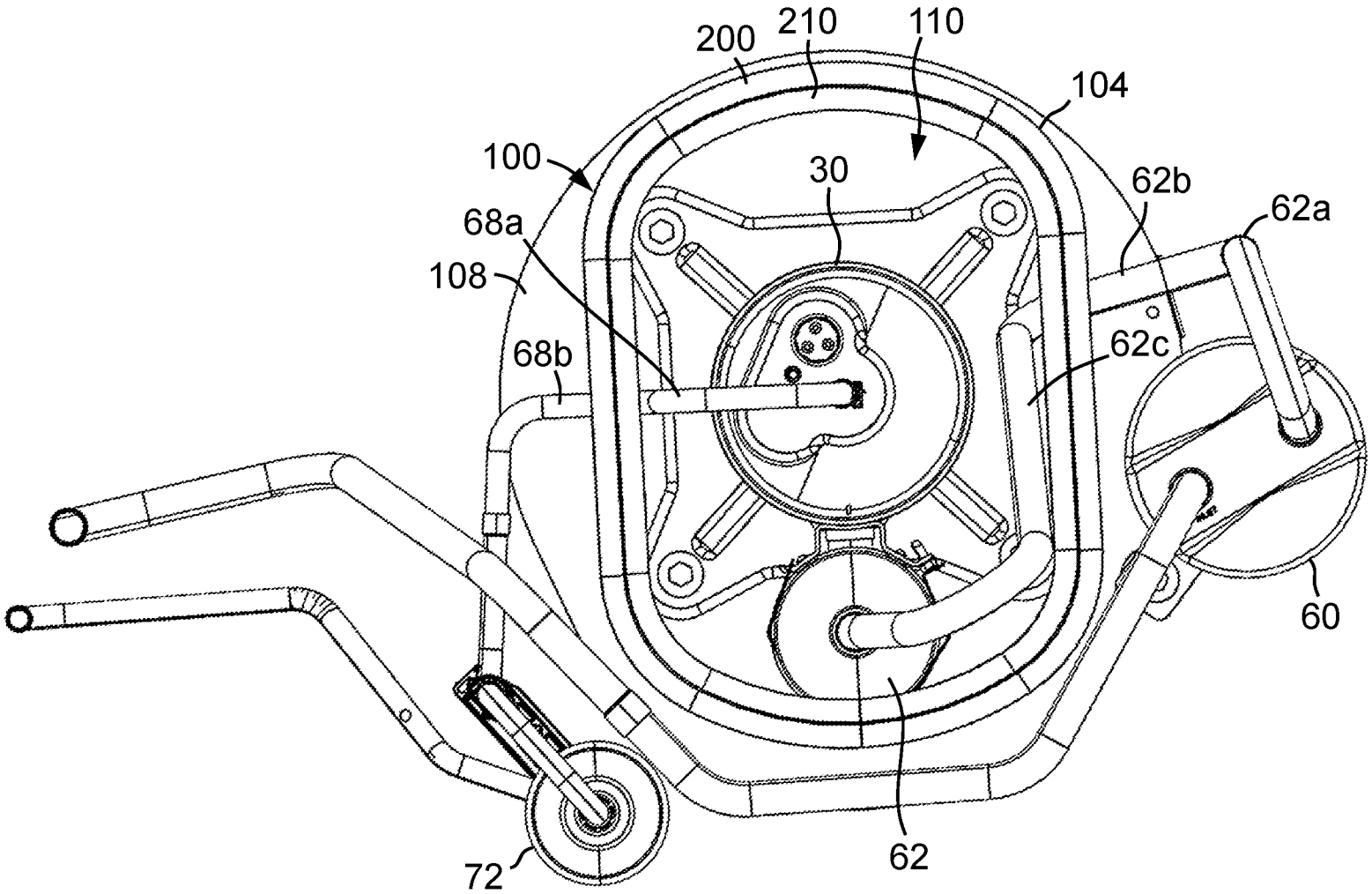
FIG. 6 is a top view of the enclosure of FIG. 3 installed over the refrigerant compressor and with a cap of the enclosure removed according to some embodiments disclosed herein.

The enclosure 100 may also be configured and positioned so as to contact various components positioned in the internal chamber 52 of housing 50 of outdoor unit 25. For instance, as shown in FIGS. 2 and 6, the side wall 104 may be sized, shaped, and configured so that an inner surface 106 of the side wall 104 is engaged with at least the second accumulator 62 (FIG. 6) and the ascending section 64*c* of the accumulator suction line 64 (FIGS. 2 and 6). In some embodiments, the side wall 104 may be engaged with other components, such as compressor 30, compressor discharge line 68 (e.g., the descending section 68*a*), etc. either in addition to or as an alternative to the second accumulator 62 and accumulator suction line 64. These intentional points of physical contact between the inner surface 106 and vibrating components within the cavity 110 act to further dampening vibration.

Referring now to FIGS. 2 and 7-9, a plurality of flapped openings 120 are defined in the side wall 104 at the bottom end 100*b*. Each flapped opening 120 may include one or more (e.g., such as one or a plurality of) flaps 122 formed in the side wall 104 that are defined by a plurality of parallel slits or cuts 124 through the side wall 104 that extend axially from the bottom end 100*b* relative to the axis 105. The flapped openings 120 may be positioned and configured to allow the passage of one or more refrigerant lines into and/or out of the cavity 110. Specifically, as shown in FIG. 2, a first flapped opening 120 may be positioned and configured to allow the accumulator suction line 64 (specifically the lower section 64*b*) to extend through the side wall 104 and into the cavity 110 of enclosure 100, and a second flapped opening 120 may be positioned and configured to allow the compressor discharge line 68 (particularly the lower section 68*b*) to extend through the side wall 104 and into the cavity 110 of enclosure 100. In some embodiments, the flap(s) 122 of each flapped opening 120 may comprise both the inner jacket 200 and outer jacket 210 (and all of the layers 202, 204, 212, 214 thereof), or may include a subset of the layers of the inner jacket 200 or outer jacket 210 (e.g., such as the fourth layer 214 of the outer jacket 210 as previously described and shown in FIG. 7).

Figure 11:
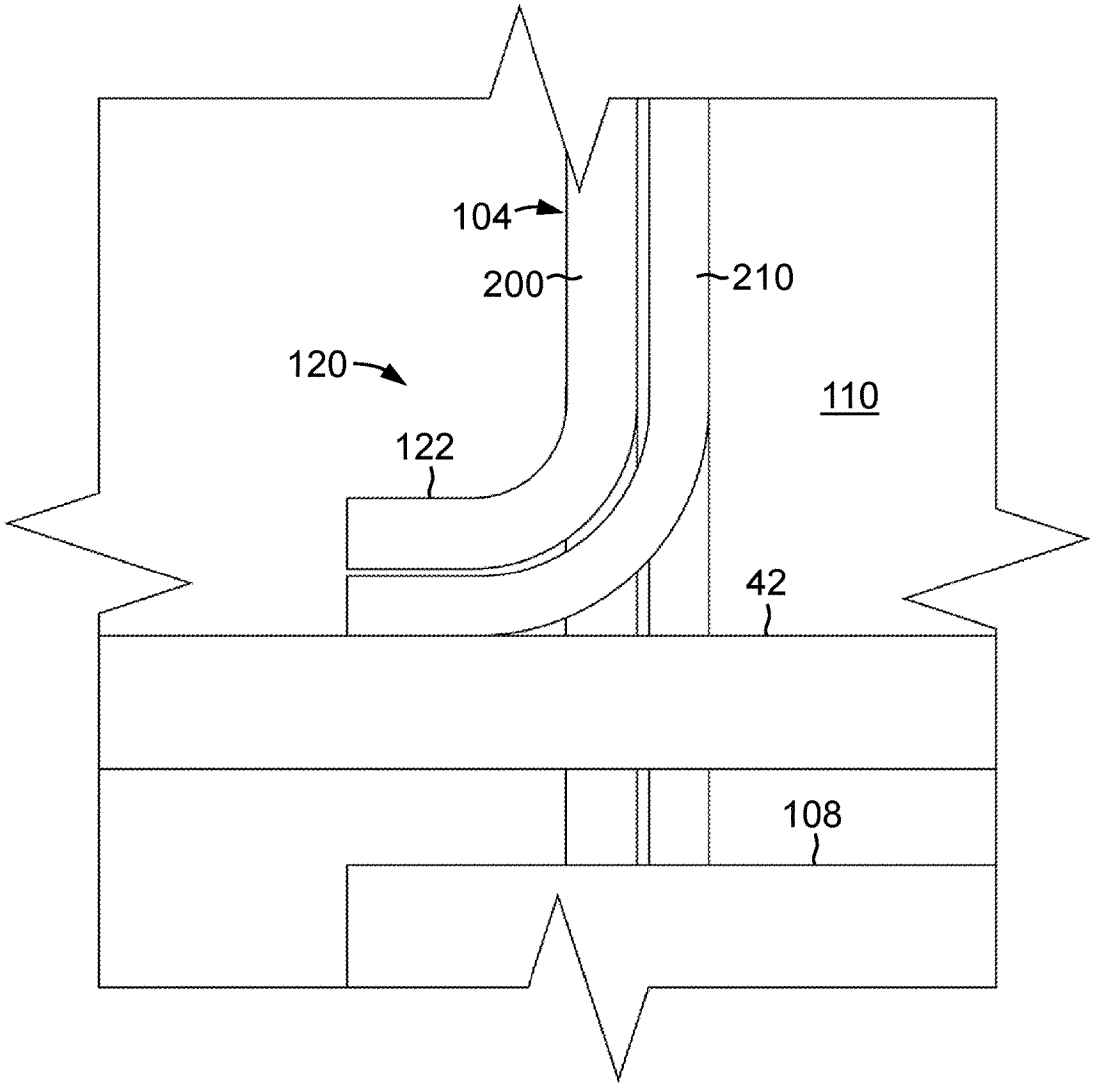
FIGS. 11-13 are enlarged, side views detailing an engagement of a flapped opening of the enclosure of FIG. 3 with a refrigerant line according to some embodiments.
Figure 12:
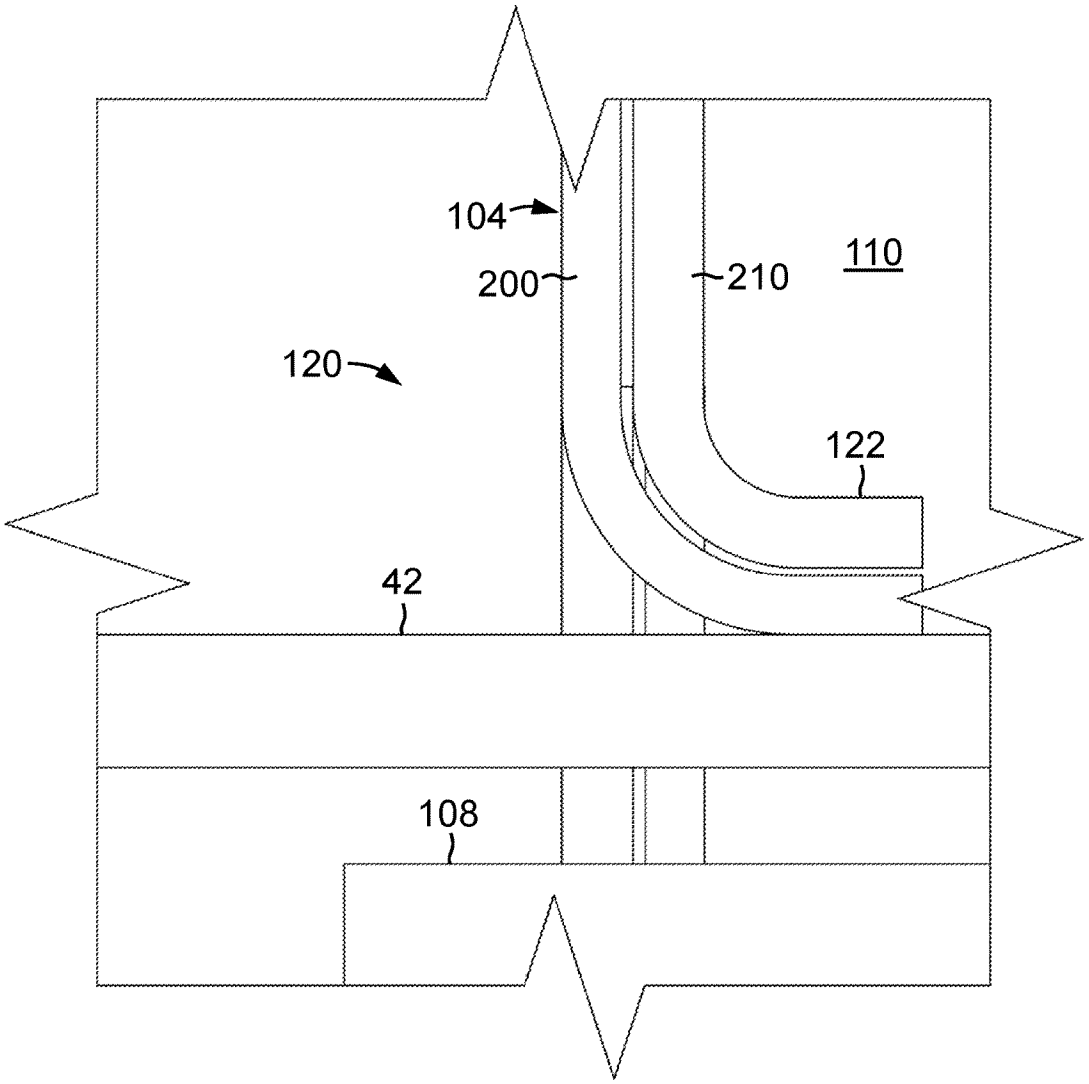

One or more of the flaps 122 of each of the flapped openings 120 may fold or deform to allow passage of a refrigerant line 42 (e.g., lines 64, 68, etc.) through the side wall 104 of enclosure 100. For instance, as shown in FIG. 11, one or more of the flaps 122 may fold or deform outward from the cavity 110 or radially away from the central axis 105 (FIG. 2) or, as shown in FIG. 12, may fold or deform into the cavity 110 or radially inward toward the central axis 105 (FIG. 2) to allow the passage of a refrigerant line 42 through the side wall 104 of enclosure 100. In either orientation (e.g., folded outward or inward), the deformed or folded flap 122 may maintain contact and at least some downward pressure or force on the refrigerant line 42 (e.g., line 64 and/or 68) to damp vibrations therein. The flap 122 may be particularly effective at damping vibration of the refrigerant lines 42 specifically because of their contract with the lower sections 64*b*, 68*b* which may otherwise tend to experience significant movement due to their extended distance from a structurally fixed portion of the respective refrigerant line. In addition, the engagement of the flap 122 with the refrigerant line 42 may facilitate the transfer of vibrations from the refrigerant line 42 into the jackets 200, 210 of enclosure 100 so that these vibrations may be further dissipated and excess movement of the corresponding refrigerant line 42 may be prevented or at least reduced.

Figure 13:
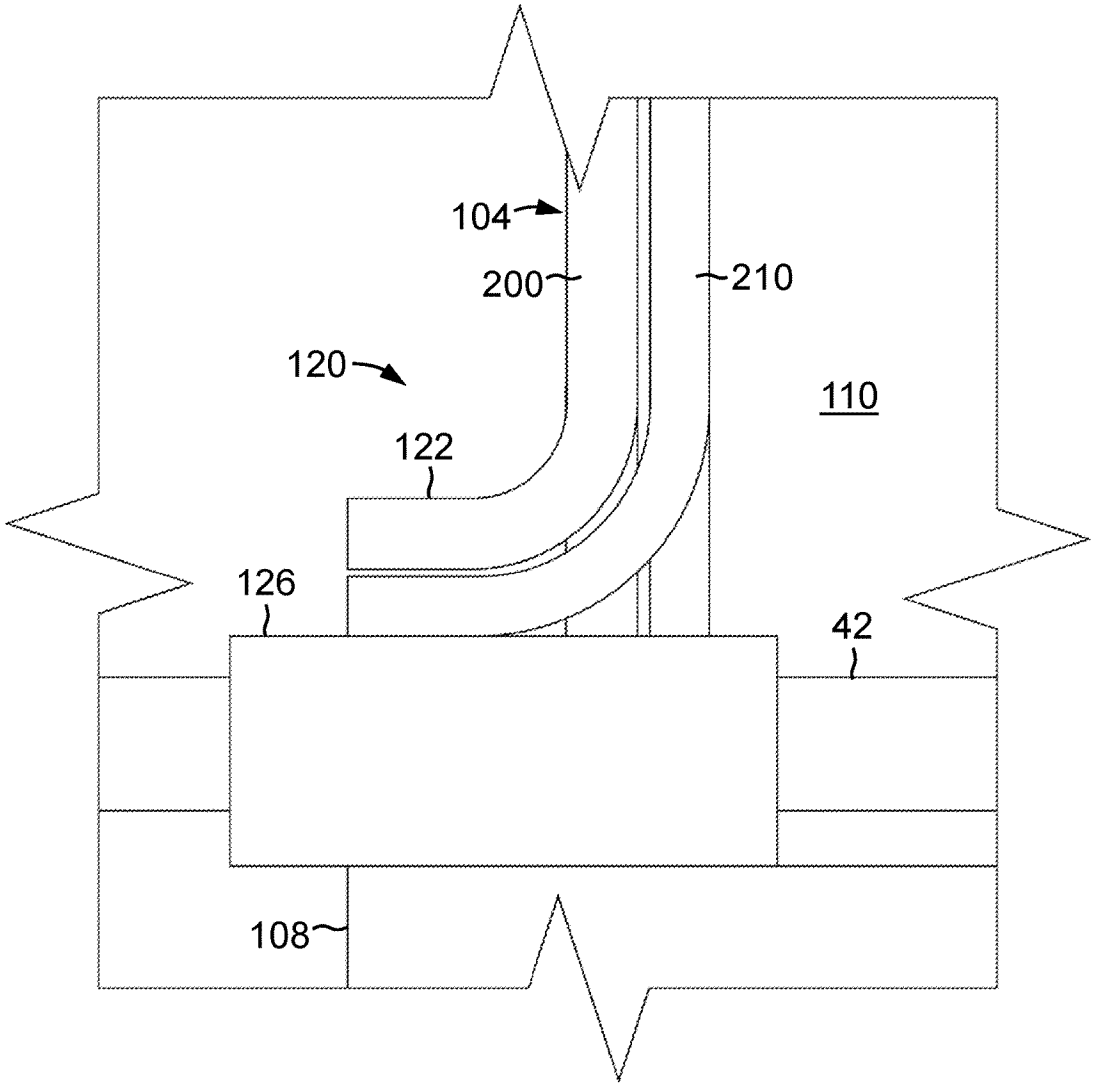

As shown in FIG. 13, in some embodiments, one or more of the refrigerant lines 42 (e.g., such as one or both of the lines 64, 68) may include an additional layer or piece of insulating material 126 positioned thereabout that is engaged between the refrigerant line 42 and the corresponding flap(s) 122 of the flapped opening 120. The additional insulating material 126 may be configured to resist abrasion or other damage to the refrigerant line 42 during operations. In some embodiments, the additional insulating material 126 may comprise foam-based pipe insulation or a similar material (such as nitrile foam pipe insulation).

As best shown in FIGS. 7 and 8, in some embodiments each of the flapped openings 120 may include a plurality of flaps 122 that are adjacent to one another along the side wall 104. Without being limited to this or any other theory, the plurality of adjacent flaps 122 for each flapped opening 120 may allow the enclosure 100 to accommodate a variety of positions, orientations, or sizes (e.g., outer diameters) of the refrigerant lines 42 (e.g., accumulator suction line 64, compressor discharge line 68, etc.), so as to facilitate installation of the enclosure 100 into the outdoor unit 25 during manufacturing.

Without being limited to this or any other theory, the engagement between the enclosure 100 and the various components and refrigerant lines (e.g., accumulator 62, refrigerant lines 64, 68) connected to and arranged about the compressor 30 may further reduce vibrations in the outdoor unit 25 during operation. For instance, as previously described, the inner surface 106 of the side wall 104 may be engaged with at least the second accumulator 62 and the ascending section 64*c* of the accumulator suction line 64, and one or more of the flaps 122 of the flapped openings 120 may be engaged with the lower sections 64*b*, 68*b* of the accumulator suction line 64 and compressor discharge line 68. These points or regions of contact may experience large amplitude vibrational movements during operation of the compressor 30. Specifically, the second accumulator 62 may be cantilevered off of the compressor 30 via the bracket 63, and thus, may experience significant vibrational oscillation relative to the compressor 30 due to the vibration emitted from the compressor 30 or the refrigerant. In addition, the ascending section 64*c* and lower section 64*b* of the accumulator suction line 64 may be spaced between the two adjacent supports at the accumulators 60, 62 and therefore may experience a greater vibrational movement during operation of the compressor 30. Likewise, the lower section 68*b* of the compressor discharge line 68 may also be spaced between a support at the compressor 30 and the stiffened U-bend 70 and therefore may also experience a greater vibrational movement during operations with the compressor 30. As a result, contacting or engaging these particular locations and components (e.g., second accumulator 62, sections 64*b*, 64*c* of accumulator suction line 64, and lower section 68*b* of compressor discharge line 68) with the enclosure 100 may facilitate direct force transfer thereto and thereby may more effectively damp vibration of these components that is induced by the compressor 30 during operations.

Referring again to FIGS. 7-9, one or more additional openings may be defined in the enclosure 100 to facilitate passage of other components therethrough. For instance, a cable notch 128 may be formed in the side wall 104 at the bottom end 100*b* that is configured to allow the routing of one or more wires into the enclosure 100. For instance, the one or more wires that are routed through the notch 128 may include one or more electrical wires to conduct electrical power and/or control signals for the compressor 30. Without being limited to this or any other theory, the cable notch 128 may prevent excess pressure from being exerted on the one or more electrical wires from the side wall 104 of enclosure 100 at bottom end 100*b*.

Figure 14:
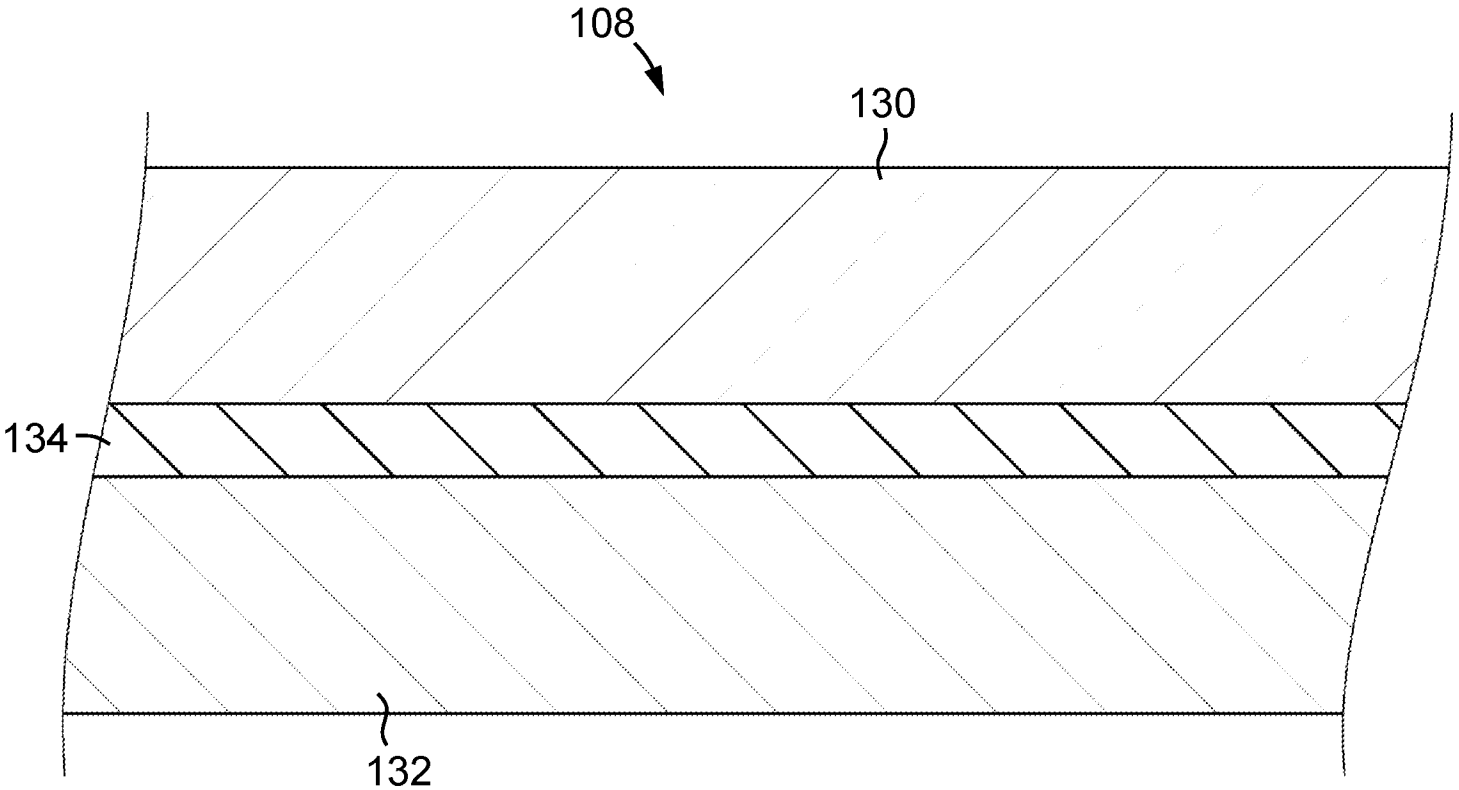
FIG. 14 is a cross-sectional view of a base plate for supporting the refrigerant compressor and enclosure of FIG. 3 according to some embodiments.

As previously described, the base plate 108 may be a laminated composite member that is configured to absorb and dissipate at least some vibrations emitted from the compressor 30 during operations (FIG. 14). FIG. 14 shows a cross-section of the base plate 108 according to some embodiments. The base plate 108 may include a pair of rigid layers or plates 130, 132 that are joined with a viscoelastic material 134 positioned therebetween. For instance, the plates 130, 132 may comprise metallic plates (e.g., such as steel), and the viscoelastic material 134 may comprise an elastomer (e.g., natural or synthetic rubber), polymer, or other suitable viscoelastic material (or composite). In some embodiments, the base plate 108 may be constructed from multi-layer laminated member metallic composite material such as QUIET STEEL® available from Material Sciences Corporation. During operations, vibrations transferred from the compressor 30 to the base plate 108 may be dissipated by relative movement or vibration of the plates 130, 132 via the viscoelastic material 134. Thus, the combination of base plate 108 and enclosure 100 may form a complete or nearly complete enclosure about the compressor 30 that may dissipate vibration emitted thereby during operations.

Referring again to FIGS. 2-6, during operation, the compressor 30 may generate and emit vibrations and sound into the cavity 110 that may then be at least partially dissipated by enclosure 100. Specifically, as previously described, the vibrations and sound emitted from the compressor 30 may travel through the airspace within cavity 110 to impact the inner walls (e.g., inner surface 106 of side wall 104, and the inner surface of cap 102) of the enclosure 100. In addition, the vibrations emitted from the compressor 30 may transfer to the base plate 108 and may be at least partially damped or dissipated therein via the viscoelastic material 134 (FIG. 14). Further, the vibrations emitted from compressor 30 may also conduct into other adjacent components, such as, for instance, the refrigerant lines 42 (particularly the accumulator suction line 64 and compressor discharge line 68) and second accumulator 62 (which is cantilevered off of the compressor 30 via bracket 63 as previously described). However, because the enclosure 100 is engaged with the second accumulator 62, the accumulator suction line 64 (particularly ascending section 64*c* and lower section 64*b*), and the compressor discharge line 68 (particularly lower section 68*b*), via the inner surface 106 of side wall 104 and the flapped openings 120 as previously described, vibrations that are conducted from the compressor 30 into these adjacent components may be damped due to the force/pressure exerted by the enclosure 100 via the contact.

Vibration and sound that are transferred to the enclosure 100 may then be at least partially dissipated by the nested jackets 200, 210. Specifically, as previously described, at least some sound and vibration may be absorbed by the sound absorbing layers 202, 212 (FIG. 10) of the jackets 200, 210, respectively. In addition, the sound and vibration transferred to the enclosure 100 may cause relative and independent deformation and movement of the inner jacket 200 and outer jacket 210 via the discontinuity 215 therebetween. As previously described, this relatively movement and deformation of the nested jackets 200, 210 may effectively convert at least some of the vibration and sound into frictional heat (e.g., due to frictional contact between the jackets 200, 210). Thus, the combination of sound absorption by the sound absorbing layers 202, 212 and frictional heat conversion via independent relative deformation of the nested jackets 200, 210 may allow the enclosure 100 to dissipate at least a portion (e.g., such as a significant portion or a majority in some cases) of the sound and vibration emitted from the compressor 30 during operations. In addition, the contact points between the enclosure 100 and the second accumulator 62 and refrigerant lines 64, 68 may at least partially arrest movement of these components so that the risk of fatigue failure (and potential loss of containment of the refrigerant) is reduced for these components (as well as other components connected thereto).

In some embodiments, the enclosure 100 may significantly reduce the vibrations in the refrigerant lines 42 coupled to the compressor 30. For instance, in some implementations, the enclosure 100 may provide about a 50% to about a 75% reduction in vibrational amplitude of one or more of the refrigerant lines 42 (which may be measured as a displacement of the refrigerant line) during operation as compared to operation without the enclosure 100.

As explained above and reiterated below, the present disclosure includes, without limitation, the following example implementations.

Clause 1: An outdoor unit for a climate control system, the outdoor unit comprising: a refrigerant compressor; a plurality of refrigerant lines coupled to the refrigerant compressor; and an enclosure positioned around the refrigerant compressor, wherein the enclosure includes an inner jacket and an outer jacket, the inner jacket being engaged with the outer jacket such that the inner jacket is configured to deform independently from the outer jacket to dissipate vibration emitted from the refrigerant compressor.

Clause 2: The outdoor unit of any of the clauses, wherein the inner jacket and the outer jacket each comprise: a sound absorbing layer configured to at least partially absorb sound; and a sound barrier layer connected to the sound absorbing layer; wherein the sound barrier layer of the inner jacket is adjacent the sound absorbing layer of the outer jacket, and wherein the sound barrier layer of the inner jacket is configured to move relative to the sound absorbing layer of the outer jacket to dissipate vibration emitted from the refrigerant compressor.

Clause 3: The outdoor unit of any of the clauses, wherein the sound absorbing layer of the inner jacket and the sound absorbing layer of the outer jacket each comprise a fibrous material or a foam material.

Clause 4: The outdoor unit of any of the clauses, wherein the sound barrier layer of the inner jacket and the sound barrier layer of the outer jacket each comprise a solid sheet.

Clause 5: The outdoor unit of any of the clauses, wherein the enclosure is engaged with the plurality of refrigerant lines so as to damp vibrations therein.

Clause 6: The outdoor unit of any of the clauses, wherein the enclosure further comprises: a top end; a bottom end; a side wall extending from the bottom end to the top end; and a flap defined in the side wall that is configured to bend relative to the side wall to engage with a first refrigerant line of the plurality of refrigerant lines so as to damp vibrations therein and to allow passage of the first refrigerant line into the enclosure.

Clause 7: The outdoor unit of any of the clauses: wherein the flap is positioned at the bottom end.

Clause 8: The outdoor unit of any of the clauses: further comprising a base plate positioned under the refrigerant compressor, wherein the bottom end of the enclosure is engaged with the base plate so that the enclosure and the base plate enclose the refrigerant compressor, and wherein the base plate comprises: a first rigid layer; a second rigid layer; and a viscoelastic material positioned between the first rigid layer and the second rigid layer.

Clause 9: The outdoor unit of any of the clauses, further comprising an accumulator supported by the refrigerant compressor, wherein the accumulator is positioned in the enclosure and engaged with an inner surface of the inner jacket so that the enclosure is configured to damp vibrations of the accumulator relative to the refrigerant compressor.

Clause 10: The outdoor unit of any of the clauses, wherein the plurality of refrigerant lines include an accumulator suction line connected to and extending from the accumulator, wherein the inner surface of the inner jacket is also engaged with at least the accumulator suction line to damp vibrations therein.

Clause 11: An outdoor unit for a climate control system, the outdoor unit comprising: a refrigerant compressor; a heat exchanger comprising one or more heat exchanger tubes positioned about the refrigerant compressor; and an enclosure positioned between the heat exchanger and the refrigerant compressor, the enclosure comprising a plurality of nested jackets that are movable relative to one another so that the enclosure is configured to convert vibration emitted from the refrigerant compressor into frictional heat between the plurality of nested jackets, each of the plurality of nested jackets including a sound absorbing layer and a sound barrier layer.

Clause 12: The outdoor unit of any of the clauses, further comprising a plurality of refrigerant lines coupled to the refrigerant compressor, wherein the enclosure includes a pair of flapped openings that are each configured to engage with a corresponding one of the plurality of refrigerant lines to dissipate vibration therein.

Clause 13: The outdoor unit of any of the clauses, wherein the enclosure comprises: a top end; a bottom end; and a side wall extending from the bottom end to the top end, wherein the pair of flapped openings are defined in the side wall at the bottom end.

Clause 14: The outdoor unit of any of the clauses, wherein each of the pair of flapped openings includes one or more flaps that are configured to bend relative to the side wall to allow passage of the corresponding one of the refrigerant lines into the enclosure.

Clause 15: The outdoor unit of any of the clauses, further comprising an accumulator that is cantilevered from the refrigerant compressor, wherein the accumulator is positioned in the enclosure such that the accumulator is engaged with an inner surface of the side wall to damp vibration of the accumulator.

Clause 16: The outdoor unit of any of the clauses, wherein the sound absorbing layer comprises a fibrous material or a foam material.

Clause 17: The outdoor unit of any of the clauses, wherein the sound barrier layer comprises a polymer material.

Clause 18: An outdoor unit for a climate control system, the outdoor unit comprising: a refrigerant compressor; a plurality of refrigerant lines coupled to the refrigerant compressor; and an enclosure positioned about the refrigerant compressor, the enclosure including: a plurality of flapped openings that receive the plurality of refrigerant lines therethrough, the plurality of flapped openings configured to apply force to the plurality of refrigerant lines to damp vibrations therein; and at least one sound absorbing layer that is configured to absorb sound emitted from the refrigerant compressor.

Clause 19: The outdoor unit of any of the clauses, wherein the enclosure comprises a plurality of nested jackets that are movable relative to one another so that the enclosure is configured to convert vibration emitted from the refrigerant compressor into frictional heat between the plurality of nested jackets, wherein the at least one sound absorbing layer is included in one of the plurality of nested jackets.

Clause 20: The outdoor unit of any of the clauses, wherein the enclosure includes: a closed top end; an open bottom end; and a side wall extending from the closed top end to the open bottom end; wherein each of the plurality of flapped openings includes a plurality of adjacent flaps defined in a side wall of the enclosure at the open bottom end.

Embodiments disclosed herein include enclosures for a refrigerant compressor of a climate control system that may dissipate both sound and vibration emitted from the refrigerant compressor during operation. In some embodiments, the enclosures disclosed herein may include a plurality of nested jackets that are loosely coupled to one another so that the vibrations emitted from the refrigerant compressor may allow independent movement and deformation of the nested jackets relative to one another. The relative, independent movement of the nested jackets may convert the vibrations (and the corresponding noise) into frictional heat during operation so as to dissipate at least a portion of the vibrations during operations. As a result, through use of the embodiments disclosed herein, the noise pollution and fatigue wear associated with a refrigerant compressor of a climate control system may be reduced.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An outdoor unit for a climate control system, the outdoor unit comprising:

a refrigerant compressor;

a plurality of refrigerant lines coupled to the refrigerant compressor; and an enclosure positioned around the refrigerant compressor, wherein the enclosure includes an inner jacket and an outer jacket, the inner jacket being engaged with the outer jacket such that the inner jacket is configured to deform independently from the outer jacket to dissipate vibration emitted from the refrigerant compressor, wherein the outer jacket is positioned about the inner jacket and the inner jacket is positioned radially closer to a central axis of the enclosure than the outer jacket, and wherein the inner jacket is engaged with the plurality of refrigerant lines so as to dampen vibrations therein.

2. The outdoor unit of claim 1, wherein the inner jacket and the outer jacket each comprise:

a sound absorbing layer configured to at least partially absorb sound; and a sound barrier layer connected to the sound absorbing layer;

wherein the sound barrier layer of the inner jacket is adjacent the sound absorbing layer of the outer jacket, and wherein the sound barrier layer of the inner jacket is configured to move relative to the sound absorbing layer of the outer jacket to dissipate vibration emitted from the refrigerant compressor.

3. The outdoor unit of claim 2, wherein the sound absorbing layer of the inner jacket and the sound absorbing layer of the outer jacket each comprise a fibrous material or a foam material.

4. The outdoor unit of claim 3, wherein the sound barrier layer of the inner jacket and the sound barrier layer of the outer jacket each comprise a solid sheet.

5. The outdoor unit of claim 1, wherein the enclosure further comprises:

a top end;

a bottom end;

a side wall extending from the bottom end to the top end; and a flap defined in the side wall that is configured to bend relative to the side wall to engage with a first refrigerant line of the plurality of refrigerant lines so as to damp vibrations therein and to allow passage of the first refrigerant line into the enclosure.

6. The outdoor unit of claim 5, wherein the flap is positioned at the bottom end.

7. The outdoor unit of claim 6, further comprising a base plate positioned under the refrigerant compressor, wherein the bottom end of the enclosure is engaged with the base plate so that the enclosure and the base plate enclose the refrigerant compressor, and wherein the base plate comprises:

a first rigid layer;

a second rigid layer; and a viscoelastic material positioned between the first rigid layer and the second rigid layer.

8. The outdoor unit of claim 6, further comprising an accumulator supported by the refrigerant compressor, wherein the accumulator is positioned in the enclosure and engaged with an inner surface of the inner jacket so that the enclosure is configured to damp vibrations of the accumulator relative to the refrigerant compressor.

9. The outdoor unit of claim 8, wherein the plurality of refrigerant lines include an accumulator suction line connected to and extending from the accumulator, wherein the inner surface of the inner jacket is also engaged with at least the accumulator suction line to damp vibrations therein.

10. An outdoor unit for a climate control system, the outdoor unit comprising:

a refrigerant compressor;

a plurality of refrigerant lines coupled to the refrigerant compressor;

a heat exchanger comprising one or more heat exchanger tubes positioned about the refrigerant compressor; and an enclosure positioned between the heat exchanger and the refrigerant compressor, the enclosure comprising a plurality of nested jackets that are movable relative to one another so that the enclosure is configured to convert vibration emitted from the refrigerant compressor into frictional heat between the plurality of nested jackets, each of the plurality of nested jackets including a sound absorbing layer and a sound barrier layer, wherein the plurality of nested jackets further includes an inner jacket and an outer jacket positioned about the inner jacket and the inner jacket is positioned radially closer to a central axis of the enclosure than the outer jacket, and wherein the inner jacket is engaged with the plurality of refrigerant lines so as to damp vibrations therein.

11. The outdoor unit of claim 10, wherein the enclosure includes a pair of flapped openings that are each configured to engage with a corresponding one of the plurality of refrigerant lines to dissipate vibration therein.

12. The outdoor unit of claim 11, wherein the enclosure comprises:

a top end;

a bottom end; and a side wall extending from the bottom end to the top end, wherein the pair of flapped openings are defined in the side wall at the bottom end.

13. The outdoor unit of claim 12, wherein each of the pair of flapped openings includes one or more flaps that are configured to bend relative to the side wall to allow passage of the corresponding one of the refrigerant lines into the enclosure.

14. The outdoor unit of claim 12, further comprising an accumulator that is cantilevered from the refrigerant compressor, wherein the accumulator is positioned in the enclosure such that the accumulator is engaged with an inner surface of the side wall to damp vibration of the accumulator.

15. The outdoor unit of claim 14, wherein the sound absorbing layer comprises a fibrous material or a foam material.

16. The outdoor unit of claim 15, wherein the sound barrier layer comprises a polymer material.

17. An outdoor unit for a climate control system, the outdoor unit comprising:

a refrigerant compressor;

a plurality of refrigerant lines coupled to the refrigerant compressor; and an enclosure positioned about the refrigerant compressor, the enclosure including:

a plurality of nested jackets that are movable relative to one another so that the enclosure is configured to convert vibration emitted from the refrigerant compressor into frictional heat between the plurality of nested jackets, the nested jackets including an inner jacket and an outer jacket, the inner jacket being engaged with the outer jacket such that the inner jacket is configured to deform independently from the outer jacket to dissipate vibration emitted from the refrigerant compressor, wherein the outer jacket is positioned about the inner jacket and the inner jacket is positioned radially closer to a central axis of the enclosure than the outer jacket;

a plurality of flapped openings that receive the plurality of refrigerant lines therethrough, the plurality of flapped openings configured to apply force to the plurality of refrigerant lines to damp vibrations therein; and at least one sound absorbing layer that is configured to absorb sound emitted from the refrigerant compressor, wherein the at least one sound absorbing layer is included in one of the plurality of nested jackets, and wherein the plurality of flapped openings are engaged with the plurality of refrigerant lines so as to damp vibrations therein.

18. The outdoor unit of claim 17, wherein the enclosure includes:

a closed top end;

an open bottom end; and a side wall extending from the closed top end to the open bottom end;

wherein each of the plurality of flapped openings includes a plurality of adjacent flaps defined in a side wall of the enclosure at the open bottom end.

19. The outdoor unit of claim 12, further comprising a base plate positioned under the refrigerant compressor, wherein the bottom end of the enclosure is engaged with the base plate so that the enclosure and the base plate enclose the refrigerant compressor, and wherein the base plate comprises:

a first rigid layer;

a second rigid layer; and a viscoelastic material positioned between the first rigid layer and the second rigid layer.

20. The outdoor unit of claim 17, further comprising a base plate positioned under the refrigerant compressor, wherein the bottom end of the enclosure is engaged with the base plate so that the enclosure and the base plate enclose the refrigerant compressor, and wherein the base plate comprises:

a first rigid layer;

a second rigid layer; and a viscoelastic material positioned between the first rigid layer and the second rigid layer.

* * * * *